United States Patent [19]

Masologites et al.

[11] 4,224,038

[45] Sep. 23, 1980

[54] PROCESS FOR REMOVING SULFUR FROM COAL

[75] Inventors: George P. Masologites, Olympia Fields; Emmett H. Burk, Jr., Glenwood; Jin S. Yoo, South Holland; John A. Karch, Chicago, all of Ill.

[73] Assignee: Atlantic Richfield Company, Philadelphia, Pa.

[21] Appl. No.: 916,666

[22] Filed: Jun. 19, 1978

[51] Int. Cl.[2] ..... C10L 9/10; C10B 57/00

[52] U.S. Cl. ..... 44/1 SR; 201/17

[58] Field of Search ..... 44/1 R, 24; 201/17

[56] References Cited

U.S. PATENT DOCUMENTS

| | | | |
|---|---|---|---|
| 3,824,084 | 7/1974 | Dillon et al. | 44/1 R |
| 4,018,571 | 4/1977 | Cole et al. | 44/24 X |

*Primary Examiner*—Carl F. Dees

*Attorney, Agent, or Firm*—John B. Goodman

[57] ABSTRACT

A process for reducing the sulfur content of coal comprising:

(1) contacting an aqueous slurry of coal-oil agglomerates at elevated temperature with oxygen; and (2) recovering coal-oil agglomerates wherein the coal has reduced sulfur content.

19 Claims, No Drawings

PROCESS FOR REMOVING SULFUR FROM COAL

BACKGROUND OF THE INVENTION

1. Field of the Invention

The field of this invention relates to a process for reducing the sulfur content of coal.

2. Prior Art

The problem of air pollution due to the emission of sulfur oxides when sulfur-containing fuels are burned has received increasing attention in recent years. It is now widely recognized that sulfur oxides can be particularly harmful pollutants since they can combine with moisture to form corrosive acidic compositions which can be harmful and/or toxic to living organisms in very low concentrations.

Coal is an important fuel, and large amounts are burned in thermal generating plants primarily for conversion into electrical energy. One of the principal drawbacks in the use of coal as a fuel is that many coals contain amounts of sulfur which generate unacceptable amounts of sulfur oxides on burning. For example, coal combustion is by far the largest single source of sulfur dioxide pollution in the United States at present, and currently accounts for 60 to 65% of the total sulfur oxide emissions.

The sulfur content of coal, nearly all of which is emitted as sulfur oxides during combustion, is present in essentially two forms: inorganic, primarily metal pyrites, and organic sulfur. The inorganic sulfur compounds are mainly iron pyrites, with lesser amounts of other metal pyrites and metal sulfates. The organic sulfur may be in the form of thiols, disulfide, sulfides and thiophenes (substituted, terminal and sandwiched forms) chemically associated with the coal itself. Depending on the particular coal, the sulfur content can be primarily in the form of either inorganic sulfur or organic sulfur. Distribution between the two forms varies widely among various coals.

In the United States, except for Western coals, the bulk of the coal produced is known to be high in pyrite. Both Appalachian and Eastern interior coals have been analyzed to the rich in pyritic and organic sulfur. Generally the pyritic sulfur represents from about 25% to 70% of the total sulfur content in these coals.

Heretofore, it was recognized that it would be highly desirable to remove (or at least lower) the sulfur content of the coal prior to combustion. A number of processes, for example, have been suggested for removing the inorganic (pyritic) sulfur from coal.

For example, it is known that at least some pyritic sulfur can be physically removed from coal by grinding the coal, and subjecting the ground coal to froth flotation or washing processes. While such processes can remove some pyritic sulfur, these processes are not fully satisfactory because a large portion of the pyritic sulfur is not removed. Attempts to increase the portion of pyritic sulfur removed have not been successful because these processes are not sufficiently selective. Because the process is not sufficiently selective, a large portion of coal can be discarded along with ash and pyrite.

There have also been suggestions heretofore to chemically remove sulfur from coal. For example, U.S. Pat. No. 3,768,988 to Meyers, issued Dec. 30, 1973, discloses a process for reducing the pyritic sulfur content of coal involving exposing coal particles to a solution of ferric chloride. The patent suggests that in this process ferric chloride reacts with pyritic sulfur to provide free sulfur according to the following reaction process:

$$2FeCl_3 + FeS_2 \text{———} 3FeCl_2 + S$$

While the process is of interest, a disadvantage of this process is that the liberated sulfur solids must then be separated from the coal solids. Processes involving froth flotation, and vaporization are proposed to separate the sulfur solids. All of these proposals, however, inherently represent a second discrete process step with its attendant problems and cost which must be employed to remove the sulfur from coal.

In another approach, U.S. Pat. No. 3,824,084 to Dillon issued July 16, 1974, discloses a process involving grinding coal containing pyritic sulfur in the presence of water to form a slurry, and then heating the slurry under pressure in the presence of oxygen. The patent discloses that under these conditions the pyritic sulfur (for example, $FeS_2$) can react to form ferrous sulfate and sulfuric acid which can further react to form ferric sulfate. The patent discloses that typical reaction equations for the process at the conditions specified are as follows:

$$FeS_2 + H_2O + 7/2O_2 \text{———} FeSO_4 + H_2SO_4$$
$$2FeSO_4 + H_2SO_4 + 1/2O_2 \text{———} Fe_2(SO_4)_3 + H_2O$$

These reaction equations indicate that in this particular process the pyritic sulfur content continues to be associated with the iron as sulfate. While it apparently does not always occur, a disadvantage of this is that insoluble material, basic ferric sulfate, can be formed. When this occurs, a discrete separate separation procedure must be employed to remove this solid material from the coal solids to adequately reduce sulfur content. In addition elemental sulfur can be formed and deposit on the coal. Removing this elemental sulfur presents a problem. Several other factors detract from the desirability of this process. The oxidation of sulfur in the process does not proceed at a rapid rate, thereby limiting output for a given processing capacity. In addition, the oxidation process is not highly selective such that considerable amounts of coal itself can be oxidized. This is undesirable, of course, since the amount of coal recovered from the process is decreased.

Heretofore, it was known that coal particles could be agglomerated with hydrocarbon oils. See, for example, U.S. Pat. No. 3,856,668 to Shubert issued Dec. 24, 1974, and U.S. Pat. No. 3,665,066 to Capes et al issued May 25, 1972. It was not known heretofore, however, that coal particles agglomerated with oil can be more amenable to sulfur removal in processes wherein the sulfur is oxidized to remove the sulfur from coal.

SUMMARY OF THE INVENTION

This invention provides a practical method for more effectively reducing the sulfur content of coal. In its broad aspect, this invention presents a process for reducing the sulfur content of sulfur-containing coal comprising:

(1) contacting an aqueous slurry of coal-oil agglomerates at elevated temperature with oxygen; and (2) recovering coal-oil agglomerates wherein the coal has reduced sulfur content.

These recovered coal-oil agglomerates can be used as a fuel exhibiting reduced sulfur content. Alternatively, the oil can be removed from the recovered coal-oil agglomerates to provide coal particles of reduced sulfur content.

DETAILED DESCRIPTION OF THE INVENTION AND ITS PREFERRED EMBODIMENTS

This invention provides a method for reducing the sulfur content of coal by a process comprising:

(1) contacting an aqueous slurry of the coal-oil agglomerates at elevated temperature with oxygen; and (2) recovering coal-oil agglomerates wherein the coal has reduced sulfur content.

The novel process of this invention is especially effective for reducing the pyritic sulfur content of coal. An advantage of the process is that it can also provide a reduction in the organic sulfur content of some coals. Another advantage of the invention is that elemental sulfur formation and deposition is reduced. An additional advantage of the invention is that it can provide a reduction in the ash content of coal.

Suitable coals which can be employed in the process of this invention include brown coal, lignite, subbituminous, bituminous (high volatile, medium volatile, and low volatile), semi-anthracite and anthracite. Regardless of the rank of feed coal, excellent pyrite removal can be achieved by the process of this invention.

Coal-oil agglomerates are formed by agglomerating fine particles of coal with hydrocarbon oil.

The particle size of the coal can vary over wide ranges. For instances, the coal may have a particle size of minus 10 mesh and as small as minus 200 mesh size is often minus 100 mesh, preferably minus 80 mesh.

Coal-oil agglomerates can be readily formed by agitating a mixture of water, hydrocarbon oil and coal particles. For example, water and hydrocarbon oil can be added to coal particles of a suitable size to form the mixture. More preferably coal is ground in the presence of water to form a slurry of coal particles and water, and hydrocarbon oil is added to the slurry to form a mixture.

The water content of the mixture is not critical and can vary within wide limits. Generally from about 30 to 95 parts water, and more preferably 40 to 90 parts water, based on the weight of coal, will be employed. There should be sufficient hydrocarbon oil present to agglomerate the coal particles. The optimum amount of hydrocarbon oil will depend upon the particular hydrocarbon oil employed and the size of the coal particles. Generally, the amount of hydrocarbon oil will be from about 5% to 60%, preferably 5% to 30%, by weight, of coal. Most preferably the amount of hydrocarbon oil will be from about 7.5% to 15%, by weight, of coal.

Suitable hydrocarbon oils for forming the coal-oil agglomerates are derived from petroleum, shale oil, tar sand and coal. Especially hydrocarbon oils are light and heavy refined petroleum fractions such as light cycle, heavy cycle oil, heavy gas oil, clarified oil kerosene, heavy vacuum gas oil, residual oils, coal tar and solvent refined coal oil. Mixtures of various hydrocarbon oils can be quite suitable; particularly when one of the materials is very viscous.

Hydrocarbon oils with a high aromatic content are most preferred.

The hydrocarbon oils employed in this invention are hydrophobic and will preferentially wet the hydrophobic coal particles. When the mixture of water, hydrocarbon oil and coal is agitated, the hydrocarbon oil wets (becomes associated with) the coal particles. These hydrocarbon wet coal particles will collide with one another under suitable agitation forming coal-oil agglomerates. In general the size of the coal-oil agglomerate is generally at least about 2 to 3 times the average size of the coal particles which make up the coal-oil agglomerates.

Agitating the mixture can be suitably accomplished using stirred tanks, ball mills or other apparatus. An apparatus which provides a zone of shearing agitation is especially suitable for agitating the mixture.

After the coal-oil agglomerates are formed, it is preferred to separate the coal-oil agglomerates using, for example, suitable screens or filters. This separation step also allows for removal of some of the mineral matter, for example, ash. Preferably the separated coal-oil agglomerates are washed with water. The separated coil-oil agglomerates are re-slurried with water, and can be employed in the process involving contacting the coil-oil agglomerates at elevated temperature with oxygen. While this is a preferred procedure, it is also within the scope of the invention to use the aqueous mixture of coal-oil agglomerates which remains after the agglomerating procedure in the process of the invention involving contacting the coal-oil agglomerates at elevated temperature with oxygen.

It is within the scope of this invention to form the coal-oil agglomerates in the same vessel in which the contacting of the aqueous slurry is to be performed.

The process of this invention involves contacting an aqueous slurry of the coal-oil agglomerates at elevated temperature with oxygen. Preferably, the aqueous slurry contains from about 5 to 70%, by weight, coal-oil agglomerates, and more preferably, from about 10 to 60%, by weight, coal-oil agglomerates and the balance water.

The aqueous slurry of coal-oil agglomerates is contacted, in a suitable vessel, for example, an autoclave, at elevated temperatures in the presence of oxygen, preferably at pressures above atmospheric, such that sulfur is preferentially oxidized without significant adverse oxidation of the coal substrate. For example, temperatures of from about 150° to 500° F., more preferably from about 175° to about 375° F., and most preferably from about 225° to 325° F. are suitably employed. The oxygen can be present as pure oxygen gas or it can be mixed with other inert gases. For example, air or air enriched with oxygen can be suitably employed as a source of gaseous oxygen. Preferably, the gaseous oxygen is above atmospheric pressure, for example, pressures of from about 10 to 500 psig., and more preferably from 100 to 400 psig., although depending on the sulfur present in the coal feed atmospheric pressure may be utilized. If the oxygen is mixed with other gases, the partial pressure of oxygen is most suitably within the pressure ranges mentioned hereinbefore.

Under these conditions, the oxygen gas and water readily remove pyritic sulfur from the coal. This removal involves oxidation of the pyritic sulfur to sulfate, poly-thionates and thiosulfate forms. As the reaction proceeds, oxygen is consumed. Additional oxygen can be added to the system to maintain a constant partial pressure of oxygen.

The coal-oil agglomerates should be maintained under these conditions for a period of time sufficient to effect a significant reduction in the pyritic sulfur content of the coal, i.e., a reduction of 50%, and more preferably, a reduction of from 70% to 95% or more, by weight, of pyritic sulfur. Generally, a time period in the range of from about 5 minutes to 2 hours can be satisfactorily employed. Preferably, a time period of from 10 minutes to 1 hour is employed. During this time, it can be desirable to agitate the aqueous slurry of coal and water. Known mechanical mixers, for example, can be employed to agitate the slurry.

When coal containing pyritic sulfur is held under these reaction conditions, the pH of the aqueous slurry falls since sulfuric acid is formed in the reaction. The final pH will be greatly dependent on the level of pyritic sulfur in the feed coal. Often the final pH is quite low, for example, the pH of the reaction slurry can fall to a pH of from about 1 to 3, or less. While good sulfur removal is obtained without regulating the pH, it has been found that if the pH of the aqueous slurry is maintained at from 6.5 to 12.0, preferably 8 to 10.0, for a time sufficient to convert at least a majority, preferably a substantial majority, of the pyrite to a removal specie that sulfur removal is enhanced.

Examples of suitable basic materials, which can be employed to regulate the pH of the aqueous slurry are alkali metal hydroxides such as sodium hydroxide, potassium hydroxide and their corresponding oxides. Other suitable basic materials include alkali metal carbonates, such as sodium carbonate, sodium bicarbonate, potassium bicarbonate, ammonia, ammonium bicarbonate and ammonium carbonate. Particularly suitable are alkaline earth metal hydroxides, their corresponding oxides, and carbonates, for example, calcium hydroxide, lime and limestone. Among these basic materials, sodium bicarbonate, potassium bicarbonate, ammonium carbonate and bicarbonate are preferred. Limestone is most preferred since it can provide the desired pH and at the same time react with sulfur species removed from the coal to form more environmentally acceptable compounds, e.g., gypsum. Suitable basic materials include suitable buffering agents, generally the salts of weak acids, for example, boric acid, and strong bases.

As noted hereinbefore, the presence of hydrocarbon oil enhances removal of sulfur from coal in the process. Just why the presence of hydrocarbon oil enhances sulfur removal is not fully understood. While not wishing to be bound by any particular theory, it is speculated that in the presence of oxygen that the hydrocarbon oils may form organic hydroperoxides and/or peroxides which may preferentially promote the oxidation of sulfur in the coal to form water separable sulfur compounds.

After holding the aqueous slurry of coal-oil agglomerates and water under the reaction conditions of the process for a sufficient time, the pyritic sulfur is substantially oxidized to water separable sulfur compounds, for example, water soluble sulfate salts, or water insoluble gypsum.

The water separable sulfur compounds are then separated from the coal-oil agglomerates. For example, the sulfur compounds in the water can be separated by separating the water and the coal-oil agglomerates. Such a liquid-solids separation is relatively simple, and can be effected in a variety of ways. Filtering with bar sieves or screens, or centrifuging, for example, can be employed to separate the coal-oil agglomerates and water.

The resulting coal-oil agglomerates are coal-oil agglomerates wherein the coal portion is reduced in sulfur content. These coal-oil agglomerates are an excellent low sulfur, reduced ash fuel and can be used as such.

If desired the oil can be removed from these coal-oil agglomerates to provide coal particles reduced in sulfur content. A variety of methods can be employed to remove the hydrocarbon oil from the coal-oil agglomerates. For example, agglomerates can be washed with an organic solvent, for example, hexane or toluene, in which the hydrocarbon oil is soluble, and separating the resulting solution from the coal particles.

The resulting coal product has a substantially reduced pyritic sulfur content and can exhibit a diminished organic sulfur content, for example, in some coals up to 30%, by weight, organic sulfur is removed. In addition the coal product can be reduced in ash. Preferably, the coal is dried prior to use or storage.

The following examples are provided to better illustrate the invention by presenting several specific embodiments.

EXAMPLE I

Upper Freeport, Kingwood Mine coal was ground and screened to provide a quantity of coal having a particle size of less then 80 mesh.

One part, by weight, of this coal and 10 parts, by weight, water were added to a beaker equipped with an electric stirrer. The stirrer was activated, and 15%, by weight of coal, of light cycle oil was added to the beaker. When the light cycle oil was added, the coal particles began to agglomerate, forming coal-oil agglomerates. Stirring was continued until agglomeration was essentially complete. The contents of the beaker were then poured onto a 40 mesh screen to recover the coil-oil agglomerates. The coal-oil agglomerates were washed with water.

One part by weight coal-oil agglomerates and 4 parts by weight water were slurried together and added to an autoclave. The autoclave was sealed and heated to 300° F. Oxygen was then introduced, and maintained at 300 psig. The coal was held under these conditions for one hour. (The initial pH of the slurry charged to the autoclave was 6.0; the final pH was 1.2.) The autoclave was then cooled, and the contents poured onto a 40 mesh screen to separate the coal-oil agglomerates and water. These coal-oil agglomerates were de-oiled by washing the coal-oil agglomerates with a hydrocarbon oil solvent (toluene and hexane) to remove the hydrocarbon oil and recover a coal product of reduced sulfur content.

The sulfur content of the feed coal before treatment, and the sulfur content of the coal after treatment are shown in Table 1 below.

TABLE I

| | Total | Sulfur Type (% Coal) | | | | |
|---|---|---|---|---|---|---|
| | Sulfur | Sulfate | Pyritic | Organic | % Ash | *DAF |
| Feed Coal | 3.30 | 0.32 | 1.96 | 1.02 | 12.7 | |
| Treated Coal | 1.08 | 0.06 | 0.19 | 0.82 | 9.8 | |

*Dry Ash Free Basis

Analysis of oil separated from the de-oiled coal-oil agglomerates indicated little or no sulfur uptake from the coal. The treated coal-oil agglomerates formed in this example are reduced in sulfur and ash content and can be very suitably employed as an improved low sulfur, low ash fuel.

EXAMPLE II

When in Example I a base (a mixture of sodium carbonate and sodium bicarbonate) was added to the coal-oil slurry charged to the autoclave such that the initial pH was 10.0 and the final pH was 8.0, the treated coal had a sulfur content shown in Table II below. The reduced sulfur content of this treated coal compared to the coal treated in Example I indicates better sulfur removal is obtained by adjusting the pH of the aqueous slurry.

TABLE II

| | Total | Sulfur Type (% Coal) | | | | |
|---|---|---|---|---|---|---|
| | Sulfur | Sulfate | Pyritic | Organic | % Ash | *DAF |
| Treated Coal | 0.79 | 0.11 | 0.10 | 0.68 | 0.68 | |

*Dry Ash Free Basis

EXAMPLE III

When in Example I, heavy gas oil, tetralin, coker oil or mixtures thereof are employed instead of light cycle oil, the same or similar results are obtained in that coal particles reduced in sulfur content are obtained.

EXAMPLE IV

This example shows the improved ash and sulfur removal obtained by oxidizing coal-oil agglomerates in accordance with the process of the invention in comparison with a process which involves oxidizing feed coal which had not been oil-agglomerated under similar conditions.

A quantity of feed coal, Upper Freeport, Kingwood Mine, was ground and screened to provide a quantity of feed coal having a particle size of less than 80 mesh. Portions of the ground feed coal were treated in accordance with the processes identified in Part A and Part B below.

PART A (Invention)

One portion of the ground coal was treated as follows:

One part, by weight, of coal and 10 parts, by weight, water were added to a beaker equipped with an electric stirrer. The stirrer was activated, and 15%, by weight of coal, of light cycle oil was added to the beaker. When the light cycle oil was added, the coal particles began to agglomerate, forming coal-oil agglomerates. Stirring was continued until agglomeration was essentially complete.

The contents of the beaker were transferred to an autoclave. The autoclave was sealed and heated to 300° F. Oxygen was then introduced, and maintained at 300 psig. The coal was held under these conditions for one hour. (The pH was not adjusted.) The autoclave was then cooled, and the contents poured onto a screen to separate the coil-oil agglomerates and water. These coal-oil agglomerates were de-oiled by washing the coal-oil agglomerates with a hydrocarbon oil solvent (toluene and hexane) to remove the hydrocarbon oil and recover a coal product of reduced sulfur content.

The ash and sulfur content of the feed coal before treatment, and the ash and sulfur content of the coal after treatment are shown in Table III below.

PART B (Comparative)

The following is not an example of the invention, but is presented for comparison purposes.

A portion of the ground feed coal was treated as follows:

One part, by weight, of coal and 10 parts, by weight, of water are added to an autoclave. The autoclave was sealed and heated to 300° F. Oxygen was then introduced, and maintained at 300 psig. The coal was held under these conditions for one hour. (The pH was not adjusted.) The autoclave was then cooled and the contents filtered to separate the coal and water. The ash and sulfur of the coal after treatment are shown in Table III below.

TABLE III

| | Total | Sulfur Type (% Coal) | | | | |
|---|---|---|---|---|---|---|
| | Sulfur | Sulfate | Pyritic | Organic | % Ash | *DAF |
| Feed Coal | 3.30 | 0.32 | 1.96 | 1.02 | 12.7 | |
| Part A Treated Coal | 1.11 | 0.07 | 0.19 | 0.85 | 9.75 | |
| Part B Treated Coal | 1.45 | 0.11 | 0.25 | 1.09 | 11.9 | |

*Dry Ash Free Basis

As can be seen the coal treated in accordance with the invention (Part A) exhibits significantly lower contents of sulfur and ash.

Coals treated in accordance with the process of this invention are especially suitable for use in industrial boilers since they exhibit reduced fouling and slagging factors, and an increased BTU content.

While this invention has been described with respect to various specific examples and embodiments, it is to be understood that the invention is not limited thereto and that it can be variously practiced within the scope of the following claims.

What is claimed is:

1. A process for reducing the sulfur content of coal comprising:

(1) contacting an aqueous slurry of coal-oil agglomerates at elevated temperature with oxygen; and (2) recovering coal-oil agglomerates wherein the coal has reduced sulfur content.

2. The process of claim 1 wherein the temperature is from about 150° F. to about 500° F.

3. The process of claim 2 wherein the oxygen is at a pressure of from about 50 to 500 psig.

4. The process of claim 3 wherein the oil is derived from petroleum.

5. The process of claim 3 wherein the oil is derived from shale oil.

6. The process of claim 3 wherein the oil is derived from tar sand.

7. The process of claim 3 wherein the oil is derived from coal.

8. The process of claim 3 wherein the oil is a refined petroleum fraction.

9. The process of claim 1 wherein the coal-oil agglomerates contain from about 5% to 60%, by weight of coal, of hydrocarbon oil.

10. The process of claim 3 wherein the coal-oil agglomerates contain from about 5% to 30%, by weight of coal, of hydrocarbon oil.

11. The process of claim 10 wherein the hydrocarbon oil is hydrocarbon oil with a high aromatic content.

12. The process of claim 3 wherein oxygen gas is mixed with inert gas.

13. The process of claim 3 wherein a pH of from about 6.5 to 12.0 is maintained by adding a basic material to the aqueous slurry.

14. The process of claim 13 wherein the basic material is an alkali metal material is selected from the group consisting of potassium hydroxide, sodium hydroxide, potassium bicarbonate, sodium bicarbonate, ammonium carbonate and bicarbonate and mixtures thereof.

15. The process of claim 13 wherein the basic material is an alkaline earth metal material.

16. The process of claim 15 wherein the alkaline earth metal material is selected from the group consisting of calcium hydroxide, limestone and mixtures thereof.

17. The process of claim 3 wherein the aqueous slurry of coal-oil agglomerates contains from about 5 to 70%, by weight, coil-oil agglomerates.

18. The process of claim 15 wherein the aqueous slurry of coal-oil agglomerates contains from about 10 to 60%, by weight, coal-oil agglomerates.

19. The process of claim 1 wherein hydrocarbon oil is removed from coal-oil agglomerates wherein the coal has reduced sulfur content to recover coal reduced in sulfur content.

* * * * *